US006158395A

United States Patent [19]

Bauklon

[11] Patent Number: 6,158,395

[45] Date of Patent: Dec. 12, 2000

[54] DOG EXCREMENT CONTAINER

[76] Inventor: Horst Bauklon, Südstrasse 8, 58540, Meinerzhagen, Germany

[21] Appl. No.: 09/339,004

[22] Filed: Jun. 23, 1999

[30] Foreign Application Priority Data

Jul. 2, 1998 [DE] Germany ..... 198 29 596

[51] Int. Cl.[7] ..... A01K 23/00

[52] U.S. Cl. ..... 119/867; 294/1.5

[58] Field of Search ..... 119/867, 868; 294/1.3, 1.4, 1.5; 220/810, 820, 824

[56] References Cited

U.S. PATENT DOCUMENTS

| | | | |
|---|---|---|---|
| 4,146,260 | 3/1979 | Carrington . | |
| 4,236,741 | 12/1980 | Emme | 294/1.5 |
| 4,262,948 | 4/1981 | Emme | 294/1.5 |
| 5,779,290 | 7/1998 | Wilke | 294/1.5 |
| 5,820,179 | 10/1998 | Tsou | 294/1.4 |
| 5,899,510 | 5/1999 | Hayes et al. | 294/1.4 |
| 6,019,405 | 2/2000 | Tsou | 294/1.4 |

FOREIGN PATENT DOCUMENTS 8910456 11/1989 Germany .

*Primary Examiner*—Peter M. Poon
*Assistant Examiner*—Yvonne R. Abbott
*Attorney, Agent, or Firm*—Edwin D. Schlindler

[57] ABSTRACT

A dog excrement container having a hollow stem, with a receptacle which is held thereon and has a ring surface, having an excrement bag whose hem is turned down over the ring surface, having a covering ring which is pivotable about an axis oriented perpendicularly to the ring surface, and having a pulling element for the covering ring, the pulling element being guided inside the hollow stem. The technical problem is the odor-tight closure of the dog excrement container and safe handling of the excrement bag. The receptacle (4) has a bowl (5) closed at the bottom, the covering ring is constructed as a covering plate (14), and, as the pulling element, a rod (19) on the one hand is guided in a longitudinal slot (6) of the hollow stem (1) and on the other hand engages in a receptacle (17) of the covering plate (14).

6 Claims, 3 Drawing Sheets

DOG EXCREMENT CONTAINER

BACKGROUND OF THE INVENTION

1. Field of the Invention

The invention relates to a dog excrement container having a hollow stem, with a receptacle which is held thereon and has a ring surface, having an excrement bag whose hem is turned down over the ring surface, having a covering ring which is pivotable about an axis oriented perpendicularly to the ring surface, and having a pulling element for the covering ring, said pulling element being guided inside the hollow stem.

2. Description of the Prior Art

In the case of the dog excrement container described in DE 89 10 456 U1, the covering ring cooperates with the ring surface of the receptacle as a gripping element for the excrement bag. However, the excrement bag is not closed, so that odors escape until the excrement bag is disposed of. Moreover, the excrement bag may fall out prematurely if the covering ring is lifted. This is undesirable for safe and hygienic handling.

SUMMARY OF THE INVENTION

The object of the invention is the odor-tight closure of the dog excrement container and safe handling of the excrement bag.

This object is achieved in accordance with the invention in that the receptacle is constructed as a bowl closed at the bottom, in that the covering ring is constructed as a covering plate and in that, as the pulling element, a rod on the one hand is guided in a longitudinal slot of the hollow stem and on the other hand engages in a receptacle of the covering plate in such a way that on actuation of the pulling element the covering plate is pivotable about the axis perpendicular to the ring surface between an open position and a closed position.

The invention differs from the prior art in that the covering plate ensures complete closure of the bowl and of the excrement bag. The covering plate is guided in a safe and protected manner by the rod enclosed by the hollow stem. The excrement bag is located inside the bowl and is closed by the covering plate. This enables safe disposal at a suitable place, avoiding soiling by the dog excrement.

Precise and torsionally rigid guidance of the covering plate is achieved in that the covering plate engages by way of a hinge pin in a bearing receptacle of the holder. This ensures an odor-tight closure.

The closure of the excrement bag after use is ensured in that the covering plate has a radial slot coming out from the center. The hem of the used excrement bag is drawn together through the radial slot, so that the excrement bag inside the bowl is closed.

The end positions of the rod are fixed in that, in the hollow stem, the longitudinal slot for the rod has two terminal clamping receptacles for fixing the rod in the end positions.

The handling of the dog excrement container is improved in that the hollow stem embraces the dog leash by way of an eye-shaped holder. Undesired movements of the hollow stem while walking the dog are avoided as a result of this connection.

Simple handling is accomplished in that the eye-shaped holder has an adhering fastener. As a result, the hollow stem can easily be connected to and detached from the dog leash.

BRIEF DESCRIPTION OF THE DRAWINGS

An exemplary embodiment is explained with reference to the drawings, in which.

DESCRIPTION OF THE PREFERRED EMBODIMENTS

Figures 1, 2:
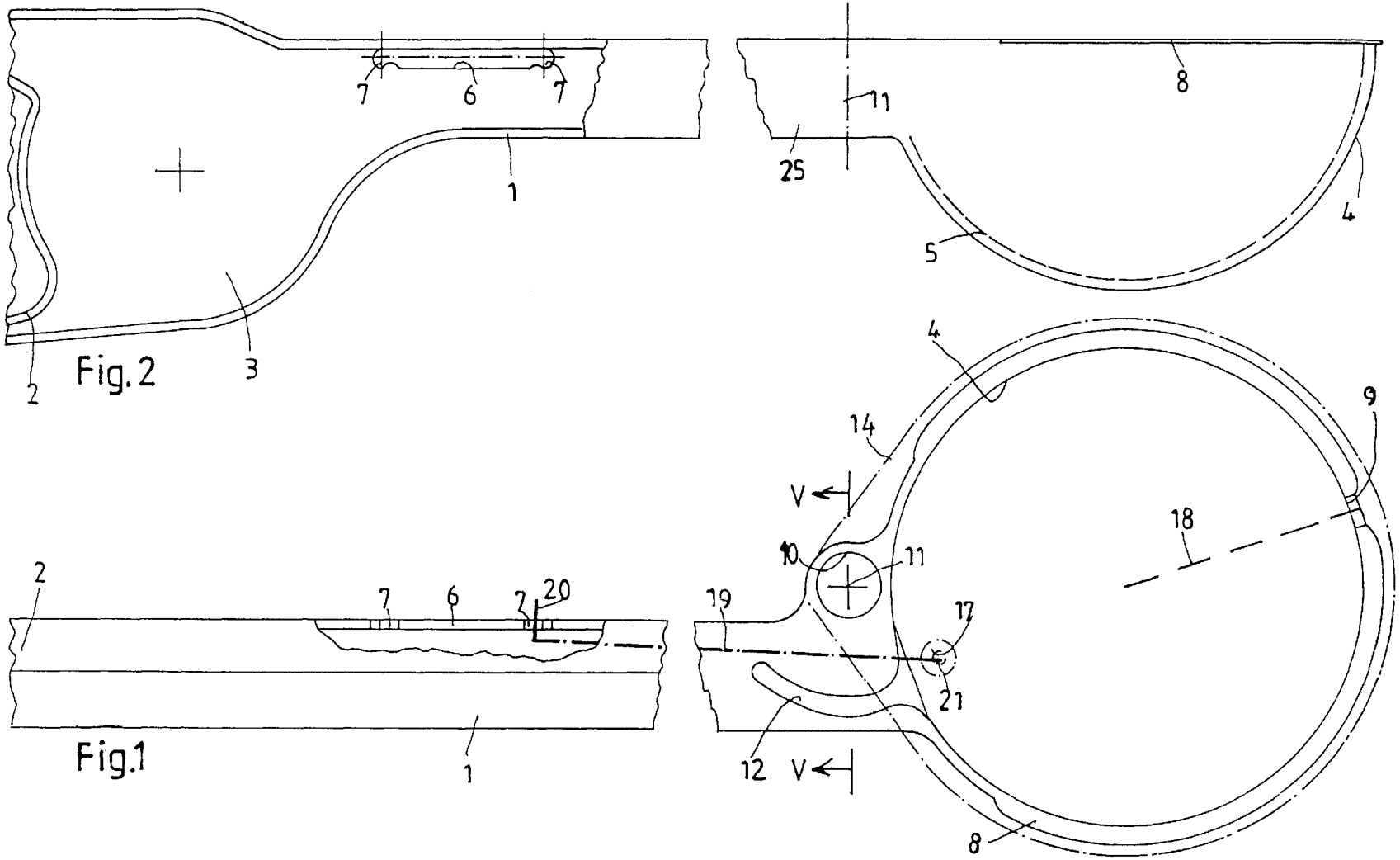
FIG. 1 shows a plan view of the dog excrement container.
FIG. 2 shows a side view relating to FIG. 1.

FIGS. 1 and 2 show a tubular hollow stem 1 having a polygonal or round cross section or a cross section composed of straight and curved segments. A handle 2, shown merely schematically, of the hollow stem 1 receives an automatic leash winder 3. The hollow stem 1 has a total length of about 1 m and at the opposite end merges into a receptacle 4 constructed as a bowl 5 closed at the bottom. At its end face, the receptacle 4 has a ring surface 8 with an indentation 9. In one side wall of the hollow stem 1 there is a longitudinal slot 6 with clamping receptacles 7 at the ends.

To the side of the longitudinal axis of the hollow stem 1 there is a bearing receptacle 10 which defines a pivot axis 11 perpendicularly intersecting the longitudinal axis of the hollow stem 1. Leading off from the ring surface 8, in the top wall of the hollow stem 1, is a circular-arc slot 12 oriented concentrically with the pivot axis 11.

The hollow stem 1 with the receptacle 4 is expediently composed of two half-parts. The half-parts, not shown in detail, are injection moulded parts. The hollow stem 1, which is constructed integrally with the leash winder 3, can be carried on the dog leash. For this purpose, an eye-shaped holder (not shown) which embraces the dog leash is joined to the portion 25 of the hollow stem 1. An adhering fastener, for example a Velcro fastener, a sliding ring or the like, enables simple, easily attachable and detachable fastening of the hollow stem.

Figure 4:
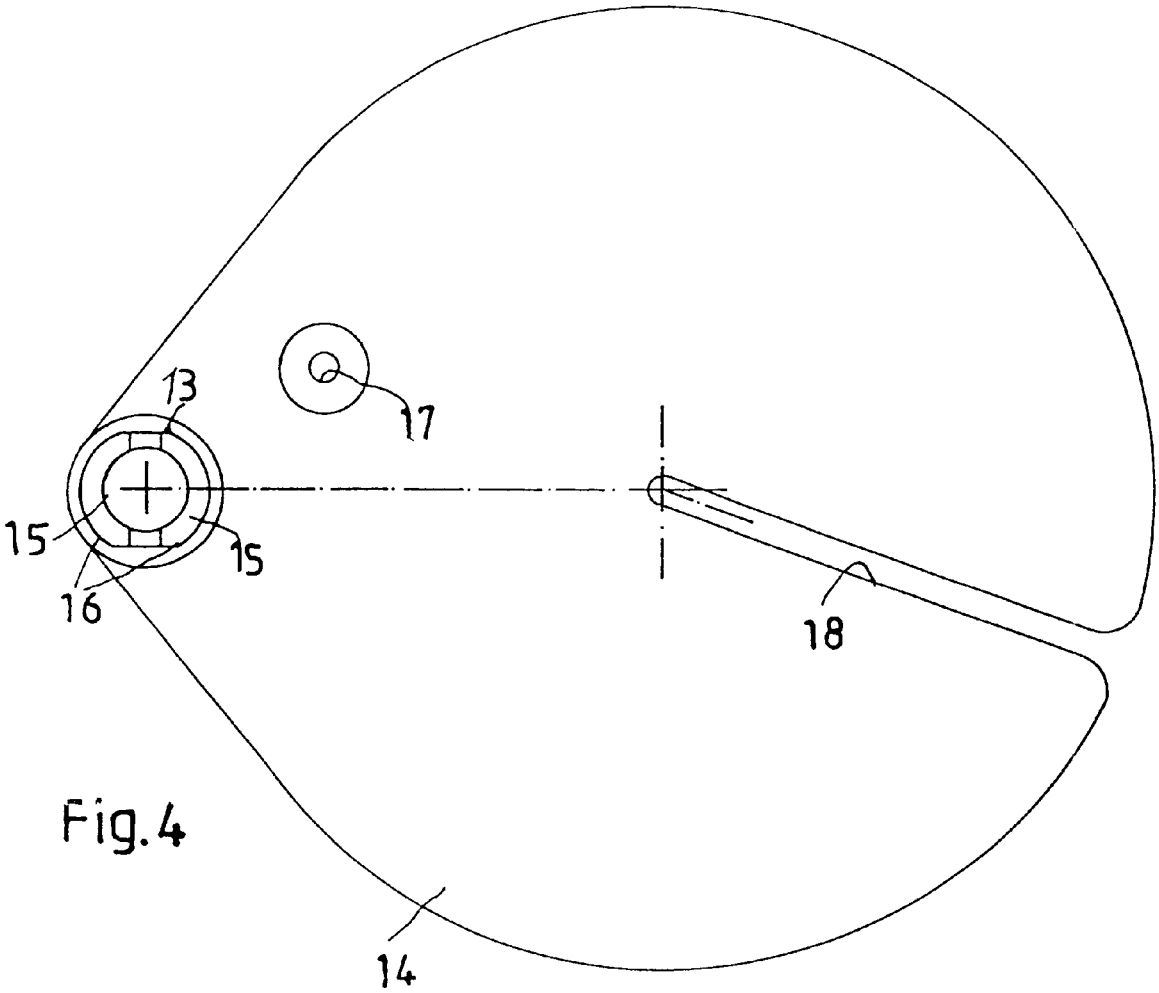
FIG. 4 shows a bottom view relating to FIG. 3.
Figure 3:
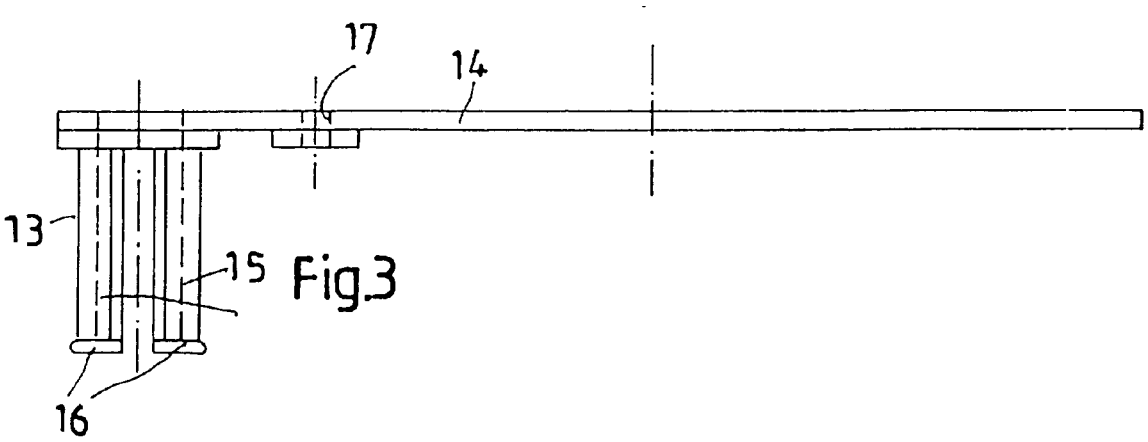
FIG. 3 shows a side view of the covering plate.
Figure 5:
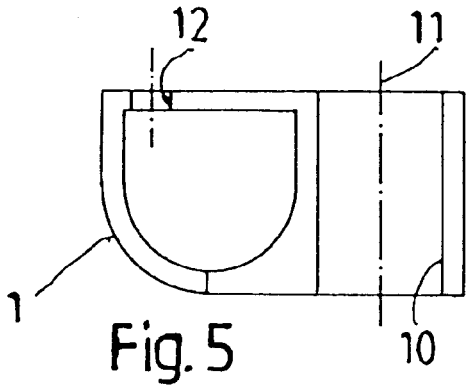
FIG. 5 shows a section along the line V—V in FIG. 1.

The bearing receptacle 10 receives a hinge pin 13 of a covering plate 14, shown in dot-dash lines in FIG. 1 and in the bottom view in FIG. 4. The hinge pin 13 comprises two half-pins 15, each having a catching bead 16, so that the hinge pin 13 can be pushed into the bearing receptacle 10 and is locked therein. The covering plate 14 furthermore has a reinforced through-passage as a mounting or receptacle 17, and a radial slot 18, shown in FIG. 1 by a dashed line.

Figure 6:
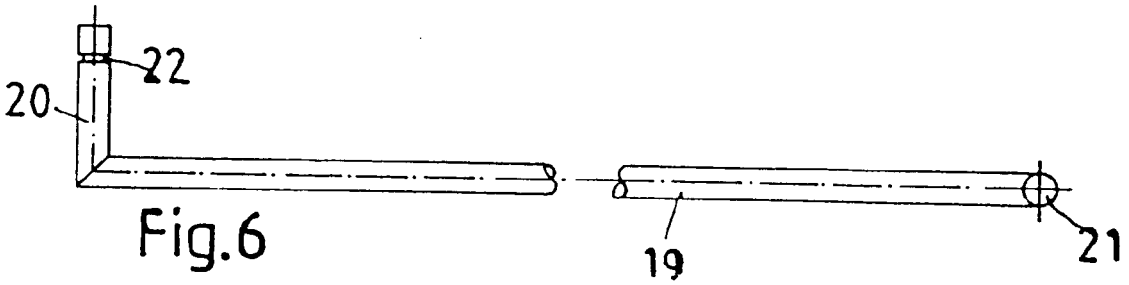
FIG. 6 shows a plan view of the pulling rod.
Figure 7:
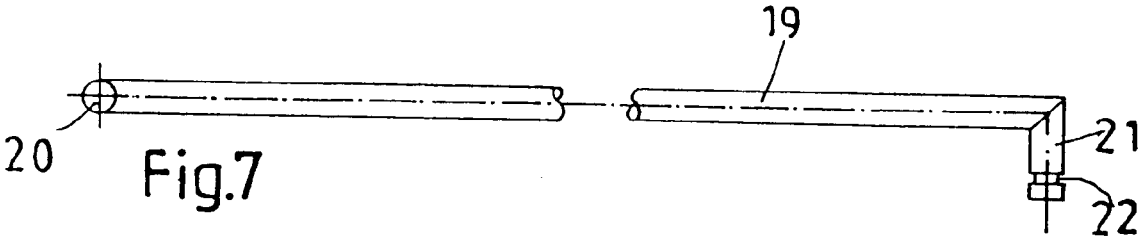
FIG. 7 shows a side view of the pulling rod.

A rod 19, in accordance with FIGS. 6 and 7, ends in two legs 20, 21 which are oriented at right angles to the rod axis and are mutually offset by 90° in the circumferential direction relative to the rod axis. Each leg 20, 21 has a circumferential catching groove 22.

Figure 8:
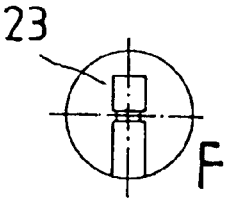
FIG. 8 shows an actuating button for the pulling rod.

After the covering plate 14 has been fitted by way of the hinge pin 13 into the bearing receptacle 10, the leg 21 of the rod 19 is inserted into the through-passage or receptacle 17 and locked therein with the aid of a ring or directly by means of the catching groove 22. The rod 19 is located, as indicated by a dot-dash line in FIG. 1, inside the hollow stem 1 and reaches through the longitudinal slot 6 by way of the leg 20. An actuating button 23 in accordance with FIG. 8 is locked onto the leg 20, to enable the rod 19 to be easily actuated. The end positions of the rod 19 are fixed by the clamping receptacles 7 of the longitudinal slot 6. One clamping receptacle corresponds to the closed position of the covering plate 14 and the other clamping receptacle corresponds to the open position of the covering plate 14. When the rod is moved inside the longitudinal slot, the leg 21 moves inside the circular-arc slot 12, so that the covering plate 14 is pivoted about the axis 11.

The dog excrement container includes an excrement bag made of paper or plastic, which is not shown. The excrement bag is terminated by a hem which receives a band, cord or the like, by means of which the excrement bag can be drawn shut after use.

To prepare for the use of the dog excrement container, by pulling the rod 19 the covering plate 14 is pivoted open, clockwise referring to FIG. 1, in order that a fresh excrement bag can be placed into the bowl, the hem of the excrement bag is pulled over the ring edge 8, and the band is tightened beneath the lip of the ring edge 8. The covering plate 14 is then pivoted back, so that the bowl is closed. The dog excrement container is held together with the dog leash or the leash winder, the dog excrement container being secured to the dog leash in the manner described above.

When the dog wishes to relieve itself, the covering plate 14 is pivoted open by means of the rod 19, so that the bowl and the excrement bag are freely accessible. The bowl is held under the dog.

After the dog has relieved itself, the covering plate 14 is pivoted back. The hem of the excrement bag is pulled up over the ring edge, and the ends of the band are moved through the slot 18 into the center of the bowl and drawn together, so that the excrement bag inside the bowl is closed. An odor-tight closure of the excrement bag is thus achieved. The excrement bag can then be disposed of at a given time and at a suitable place. With this handling the person walking the dog never comes into contact with the excrement.

What is claimed is:

1. A dog excrement container comprising a hollow stem, with a receptacle which is held thereon and has a ring surface, having an excrement bag whose hem is turned down over the ring surface, having a covering ring which is pivotable about an axis oriented perpendicularly to the ring surface, and having a pulling element for the covering ring, said pulling element being guided inside the hollow stem, wherein the receptacle is constructed as a bowl closed at the bottom, wherein the covering ring is constructed as a covering plate and wherein, as the pulling element, a rod on the one hand is guided in a longitudinal slot of the hollow stem and on the other hand engages in a receptacle of the covering plate in such a way that on actuation of the pulling element the covering plate is pivotable about the axis perpendicular to the ring surface between an open position and a closed position.

2. A dog excrement container as claimed in claim 1, wherein the covering plate, in order to form the pivot axis, engages by way of a hinge pin in a bearing receptacle of the hollow stem.

3. A dog excrement container as claimed in claim 1, wherein the covering plate has a radial slot coming out from the center.

4. A dog excrement container as claimed in claim 1, wherein, in the hollow stem, the longitudinal slot for the rod has two terminal clamping receptacles for fixing the rod in the end positions.

5. A dog excrement container as claimed in claim 1, wherein the hollow stem, embraces the dog leash by way of an eye-shaped holder.

6. A dog excrement container as claimed in claim 5, wherein the eye-shaped holder has an adhering fastener.

* * * * *